United States Patent [19]

Crane et al.

[11] 3,976,477

[45] Aug. 24, 1976

[54] HIGH CONDUCTIVITY HIGH TEMPERATURE COPPER ALLOY

[75] Inventors: Jacob Crane, Woodbridge; Eugene Shapiro, Hamden, both of Conn.

[73] Assignee: Olin Corporation, New Haven, Conn.

[22] Filed: Dec. 23, 1974

[21] Appl. No.: 535,221

[52] U.S. Cl. ..... 75/153; 148/11.5 R; 148/13.2; 148/160

[51] Int. Cl.[2] ..... C22C 9/00

[58] Field of Search ..... 75/153; 148/11.5 R, 148/32.5, 160, 13.2

[56] References Cited

UNITED STATES PATENTS

| | | | |
|---|---|---|---|
| 2,066,512 | 1/1937 | Archer | 75/153 |
| 2,123,628 | 7/1938 | Hensel et al. | 75/153 |
| 2,357,190 | 8/1944 | Evans | 75/159 |
| 2,795,501 | 6/1957 | Kelly | 75/153 |
| 2,802,733 | 8/1957 | Bungardt | 75/162 X |
| 3,253,910 | 5/1966 | Burghoff et al. | 75/153 X |
| 3,525,605 | 8/1970 | Pynna | 75/153 X |
| 3,677,745 | 8/1972 | Finlay et al. | 75/153 |
| 3,738,827 | 6/1973 | Pryor | 75/76 |

FOREIGN PATENTS OR APPLICATIONS

| | | | |
|---|---|---|---|
| 192,124 | 9/1957 | Germany | 75/153 |
| 21,182 | 7/1970 | Japan | 75/153 |
| 206,095 | 1/1968 | U.S.S.R. | 75/153 |
| 279,320 | 11/1970 | U.S.S.R. | 75/153 |

*Primary Examiner*—Walter R. Satterfield
*Attorney, Agent, or Firm*—David A. Jackson; Robert H. Bachman

[57] ABSTRACT

A high conductivity high temperature copper alloy containing mischmetal and phosphorus in a specific ratio. The alloy is free from internal copper oxides and is suitable for applications requiring stability at elevated temperatures. Strengths on the order of 70 KSI and conductivities on the order of 90% IACS are obtainable in cold worked material.

7 Claims, 2 Drawing Figures

HIGH CONDUCTIVITY HIGH TEMPERATURE COPPER ALLOY

BACKGROUND OF THE INVENTION

The present invention relates to high conductivity high temperature copper alloys, and particularly to such alloys which are free from internal copper oxides.

Oxygen free copper must be used in applications where the alloy is to be annealed in a hydrogen containing atmosphere, as the presence of oxygen in either its elemental state or as copper oxide results in the formation of water vapor during the annealing process which causes embrittlement of the alloy.

Two major methods are used to reduce the oxygen level of copper so as to avoid embrittlement. The first method involves casting the alloy in an inert atmosphere and fluxing the molten copper with an inert gas to reduce the oxygen level. This is a complex process and difficult to perform satisfactorily. The other major method of deoxidizing copper consists of adding a reactive material to the melt which will form an oxide in preference to copper oxide. The reactive material is chosen so that its oxide will be stable and will not be reduced by hydrogen during annealing. Unfortunately, most of the reactive materials used have a highly deleterious effect on electrical conductivity if excess reactive material remains in solution in the deoxidized copper alloy. Because of the reactive nature of the materials used, it is difficult to accurately control the amount of reactive material which is actually needed to deoxidize the molten copper without causing a loss of conductivity.

In addition to the above, it is known that oxygen free copper has relatively low mechanical properties and it is highly desirable to improve these properties while simultaneously maintaining a high electrical conductivity. Further, oxygen free copper has a very low softening point and for many applications it would be highly desirable to maximize strength and conductivity and to increase the softening temperature. Finally, care must be taken in the processing of oxygen free copper to avoid the reintroduction of oxygen into the alloy. For example, when welding oxygen free copper, an inert atmosphere must be used so as to protect the molten material in the weld zone from oxidation.

Mischmetal has been used as a deoxidizing material in the production of oxygen free copper, however, when excess mischmetal is present a low melting point eutectic forms between Cu and CeCu6 compound which results in an alloy which is unsuitable for high temperature brazing and other similar applications where high temperatures are encountered.

SUMMARY OF THE INVENTION

In accordance with the present invention, copper base alloys possessing high conductivity and temperature stability together with freedom from internal copper oxides are prepared which contain mischmetal or lanthanides in place thereof, and phosphorus with the balance essentially copper. Mischmetal content of the alloys of the present invention ranges from 0.03 about 0.5% and the phosphorus content will range from about 0.01 to about 0.1%. The phosphorus and mischmetal contents of the present invention are interrelated, and a specific ratio of mischmetal to phosphorus must be maintained for improved results.

The alloys of the present invention are characterized by improved oxidation resistance in high temperature contact with air. Since the preparation in accordance with the present invention employs a chemical deoxidizing technique, the alloys are resistant to internal copper oxide formation and subsequent hydrogen embrittlement during hot processing or other elevated temperature exposure. This is a significant advantage over high purity copper produced by a mechanical type of degassing operation which is susceptible to surface oxidation and internal formation during thermal applications such as welding conducted in oxygen containing atmosphere.

The alloys of the present invention likewise exhibit improved properties in comparison with conventionally produced oxygen free copper and copper which has been deoxidized with mischmetal alone. Increases on the order of 50°C are observed in softening temperatures and improvements are noted in tensile properties.

Accordingly, it is a principal object of the present invention to provide a copper base alloy in the deoxidized condition which possesses high conductivity and thermal stability.

It is a further object of the present invention to provide a copper base alloy as aforesaid which is easily and inexpensively fabricated.

It is yet a further object of the present invention to provide an alloy as aforesaid which is resistant to surface and internal oxidation during high temperature contact with oxygen containing atmosphere.

Further objects and advantages will be apparent after a consideration of the invention proceeds with reference to the description and the drawings.

DESCRIPTION OF THE PREFERRED EMBODIMENTS

In accordance with the present invention the foregoing objects and advantages are readily obtained.

The alloys of the present invention are copper base alloys comprising mischmetal and phosphorus, with the balance essentially copper. The mischmetal content ranges from about 0.03 to about 0.5% and preferably from about 0.05 to about 0.4%, and the phosphorus content ranges from about 0.01 to about 0.1% and preferably from about 0.02 to about 0.1%. Quantities of mischmetal less than those specified above are insufficient to insure complete and uniform deoxidation of the copper, and there is little or no benefit to be obtained from exceeding the above specified values. Mischmetal is a mixture of rare earth metals which comprise Elements Nos. 58–71 on the Periodic Table. A typical mischmetal composition is listed below:

| | |
|---|---|
| Cerium | 50% |
| Lanthanum | 27% |
| Neodymium | 16% |
| Praseodymium | 5% |
| Other Rare Earth Metals | 2% |

As used in this application, the term mischmetal is intended to include any material comprised predominantly of lanthanide regardless of the relative proportions thereof. For example, cerium alone could be used in place of mischmetal and would provide equally satisfactory results.

The present invention utilizes mischmetal and phosphorus in combination, as the excess of both elements present after the deoxidation of the copper react to form an intermetallic compound and thereby remove themselves from solid solution. This compound formation eliminates the incipient melting problem associated with the use of mischmetal and likewise the conductivity problem experienced with phosphorus. By controlling the ratio of excess mischmetal to excess phosphorus, the properties of the final alloy may be accurately predicted, and alloys possessing a wide range of properties may be prepared.

The aforenoted ratio of mischmetal to phosphorus corresponds to the stoichiometric weight ratio required to form the compound CeP which is 4.52:1, mischmetal:phosphorus. When excess mischmetal is present, there is no deleterious effect on strength or conductivity, however, when the amount of mischmetal exceeds 0.05% of the stoichiometric ratio, incipient melting occurs, which is a problem experienced in high temperature applications such as, for example, brazing or spot welding. This incipient melting is believed to be caused by a formation of a low melting point eutectic between the compound $CeCu_6$ and Cu.

The preceding discussion has assumed that the compounds formed are based on cerium, however, it can be appreciated that because of the great chemical similarity between the lanthanides, analogous compounds can be formed which are based on other members of that series which will possess similar characteristics.

Figure 1:
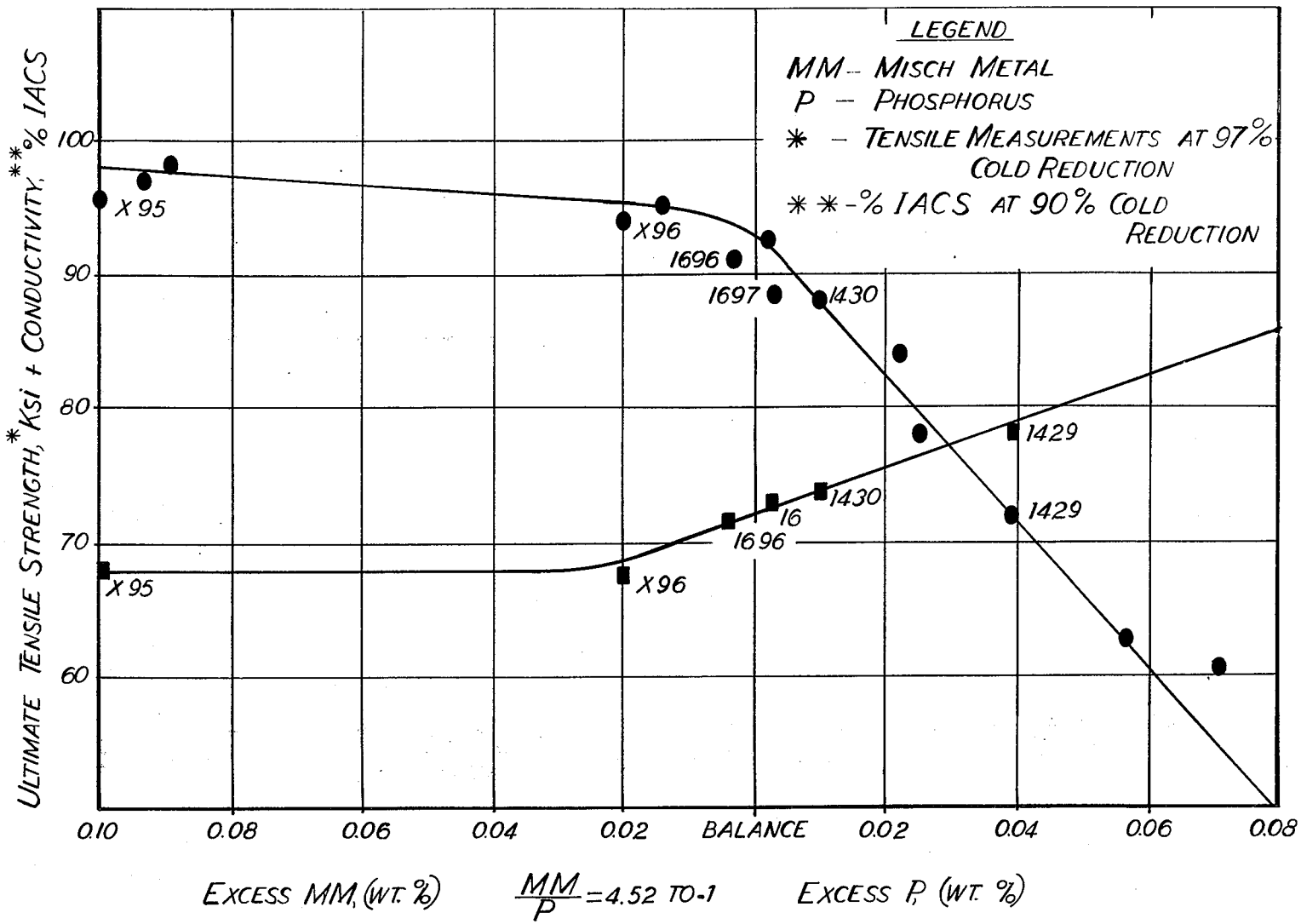
FIG. 1 is a graph comparing ultimate strength and conductivity against excess mischmetal and phosphorus contents of the alloys of this invention.

If the achievement of high conductivity in the alloys of this invention is important, excess phosphorus should be avoided because of the strong deleterious effect of phosphorus on conductivity. FIG. 1 shows the effect of excess phosphorus and excess mischmetal on ultimate tensile strength in a copper base alloy containing mischmetal and phosphorus. It can be seen that excess phosphorus has a strong negative effect on conductivity which may be characterized by the following equation: conductivity (IACS) equals 93 minus the quantity 535 times excess phosphorus. Likewise, phosphorus has an effect on ultimate tensile strength with the result that excess phosphorus increases ultimate tensile strength in a manner approximately given by the following equation: ultimate tensile strength (KSI) equals 72 plus the quantity 175 times excess phosphorus. Accordingly, if conductivity is important the alloy should be produced to contain excess mischmetal, and if exposure to temperatures above 860°C is contemplated, the excess mischmetal should be limited to 0.05% maximum. However, alloys having a range of desirable properties may be obtained by providing excess phosphorus, and these alloys may be determined by reference to FIG. 1 and the preceding equations.

Figure 2:
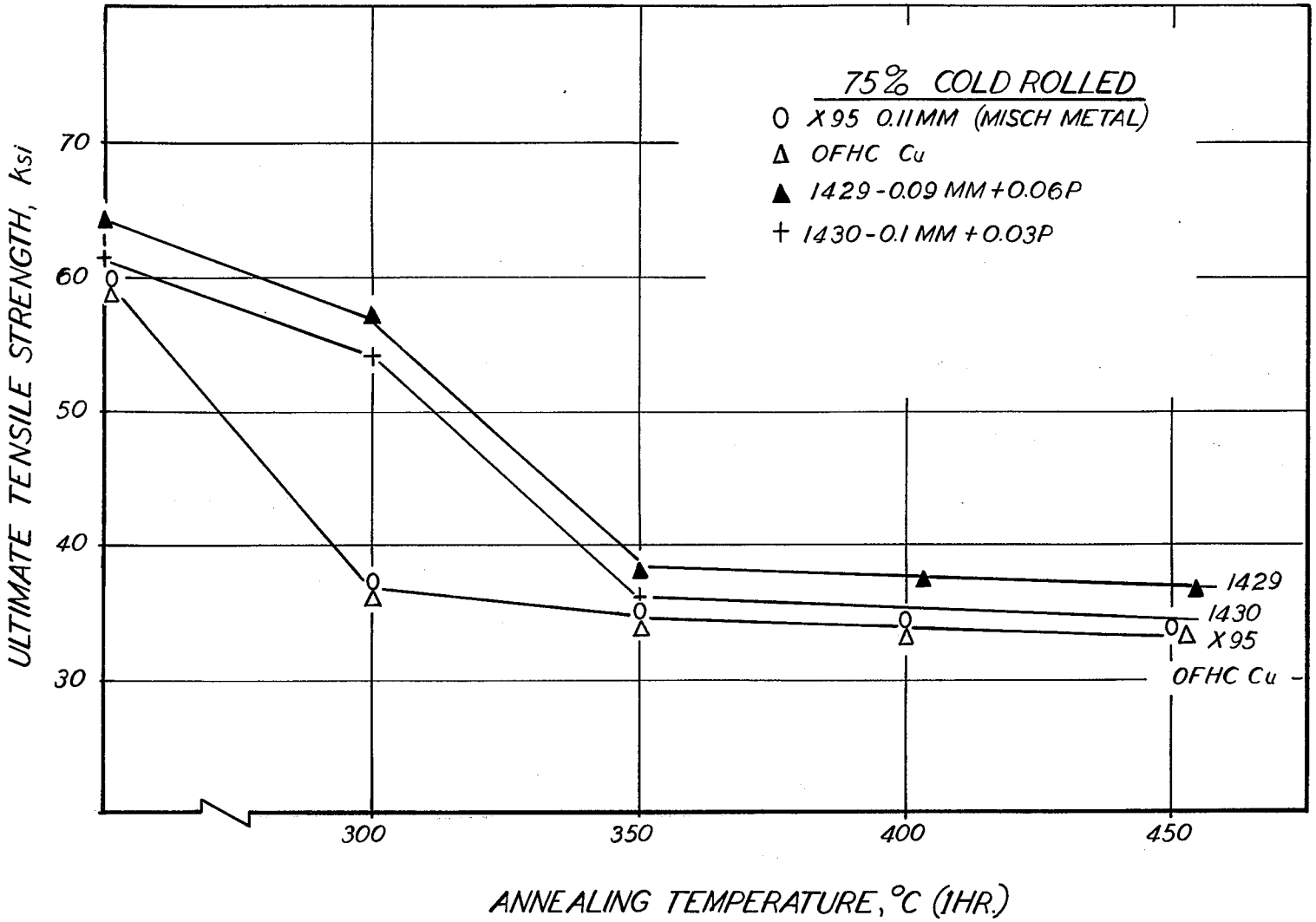
FIG. 2 is a graph comparing ultimate tensile strength against annealing temperature for alloys which were cold rolled 75%.

FIG. 2 shows high temperature behavior of the alloys of the present invention for one hour exposure time. It can be seen that alloys containing a combination of phosphorus and mischmetal have a softening temperature approximately 50°C higher than the softening temperature of conventional oxygen free copper and copper containing mischmetal alone. This added softening resistance is a useful property of the alloys of the present invention and permits them to be used in applications where conventional oxygen free coppers are not satisfactory.

The alloys of the present invention possess a further significant advantage over conventionally prepared oxygen free copper in that they retain their resistance to oxide formation even when exposed to high temperature in air, as for example in a welding application, since the mischmetal and phosphorus which remain in the alloy will oxidize in preference to the copper constituent. Accordingly, even after the alloy has been welded in air it may be annealed in hydrogen without embrittlement.

The alloys of the present invention are generally processed in accordance with conventional practice with the exception of the addition of alloying elements. Because of the reactive nature of the additives involved, it is preferable to add the mischmetal in a continuous form immediately before the molten metal enters the mold. This form of addition is particularly practical in a continuous casting operation. Reference is made to U.S. Pat. No. 3,738,827 which deals with this subject and which is assigned to the assignee of the present invention. Because phosphorus is also reactive, it may be added in a similar fashion, however, such is not absolutely necessary and the phosphorus may be added in bulk form to the molten metal. Subsequently, casting of the alloys of the present invention may be performed using conventional techniques and, in general, the methods used will be similar to those used for other high copper alloys.

The present invention will be more readily understandable from a consideration of the following illustrative examples.

EXAMPLE I

Alloys of various compositions were prepared by melting copper and adding the elemental additions wrapped in copper foil be rapidly submerging the addition below the surface of the melt. After stirring for one to two minutes, the melts were poured by the Durville process. The alloys were hot rolled in a temperature range of 300° to 800°C and several samples were subjected to various cold rolling and annealing sequences in preparation for subsequent testing. The various compositions prepared are set forth in Table I, below.

TABLE I

ANALYSIS AND HOT ROLLED CONDUCTIVITY OF EXPERIMENTAL ALLOYS

| Alloy | *MM Wt. % | **P Wt. % | M:P Ratio | Conductivity % IACS |
|---|---|---|---|---|
| X95 | 0.11 | — | — | 96.5 |
| X96 | 0.02 | — | — | 95.0 |
| 1431 | 0.05 | — | — | 98.0 |
| 1600 | 0.11 | 0.005 | 22 | 98.0 |
| 1586 | 0.12 | 0.006 | 20 | 97.0 |
| 1588 | 0.05 | 0.008 | 6.25 | 95.0 |
| 1602 | 0.10 | 0.020 | 5.0 | 92.5 |
| 1696 | 0.14 | 0.030 | 4.67 | 94.0 |
| 1697 | 0.32 | 0.074 | 4.32 | 92.0 |
| 1599 | 0.10 | 0.024 | 4.17 | 92.5 |
| 1430 | 0.10 | 0.032 | 3.13 | 89.0 |
| 1586 | 0.10 | 0.044 | 2.27 | 84.0 |
| 1589 | 0.06 | 0.038 | 1.58 | 78.0 |
| 1429 | 0.09 | 0.054 | 1.53 | 73.0 |
| 1587 | 0.08 | 0.075 | 1.07 | 63.0 |
| 1590 | 0.05 | 0.082 | 0.6 | 61.0 |

*MM - Mischmetal
**P - Phosphorus

EXAMPLE II

Samples prepared in accordance with Example I were tested for their ability to avoid incipient melting at 900°C. The samples were heated to temperature and observed, and the results were noted and are presented in Table II, below.

TABLE II

DETERMINATION OF INCIPIENT MELTING 900°C EXPOSURE FOR 10 MINUTES TO ONE HOUR

| Alloy | Composition, Wt. % Cu | *MM | P | Excess MM, Wt. %** | Incipient Melting |
|---|---|---|---|---|---|
| X96 | bal | 0.02 | — | 0.02 | No |
| 1430 | bal | 0.05 | — | 0.05 | No |
| X95 | bal | 0.11 | — | 0.11 | Yes |
| 1429 | bal | 0.09 | 0.054 | None | No |
| 1696 | bal | 0.14 | 0.030 | 0.004 | No |

*Mischmetal

**Represents MM content not participating as rare earth phosphides. Phosphides have a stoichiometric MM/P ratio of 4.52 to 1.

Referring to the table, it was observed that the samples possessing a mischmetal content above 0.05 weight percent exhibited incipient melting during exposure even for brief periods at 900°C. It was noted, however, that the addition of phosphorus coupled with the presence of mischmetal not exceeding 0.05 weight percent above CeP stoichiometry in accordance with the present invention prevented the occurrence of incipient melting.

EXAMPLE III

Additional samples prepared in accordance with Example I were tested by being cold worked 75 and 90%, respectively, and then heated to determine their resistance to softening. Samples of oxygen free high conductivity copper (OFHC) and silver-bearing copper Alloy No. 129 were similarly tested for purposes of comparison. Results of these tests are presented in Table III, below.

TABLE III

| Alloy | One Hour Softening* Temperature°C After 75% Cold Rolling |
|---|---|
| OFHC | 215 |
| X95 | 260 |
| X96 | 230 |
| 1430 | 325 |
| 1429 | 330 |
| **Alloy** | **One Hour Softening* Temperature°C After 90% Cold Rolling** |
| 129 | 315 |
| 1696 | 325 |
| 1697 | 330 |
| **Alloy** | **Time to Soften** at 395°C** |
| 129 | less than 5 minutes |

TABLE III-continued

| | |
|---|---|
| 1697 | 7½ minutes |

*50% drop in 0.2% YS

**50% drop in R30T Hardness

It can be seen that the softening temperature of sample No. 1430, representing an alloy of the present invention exceeded the observed temperature of OFHC by approximately 110°C. Likewise, in the tests conducted after 90% cold rolling, the alloys of the present invention exceeded conventional Alloy No. 129 by as much as 15°C and resisted softening at 395°C for an additional 2½ minutes. The above results clearly illustrate the improved resistance to softening exhibited by the alloys of the present invention.

EXAMPLE IV

Additional tensile testing was conducted between selected alloys prepared in accordance with Example I and commercial OFHC copper and DHP copper (phosphorus deoxidized, high residual phosphorus). The samples were tested for mechanical properties and conductivity at 90% cold rolling. The results of these tests, together with the respective materials and their compositions are set forth in Table IV, below.

TABLE IV

MECHANICAL PROPERTIES AND CONDUCTIVITY AT 90% COLD ROLLING

| Alloy | P Wt. % | MM Wt. % | CU Wt. % | Ultimate Tensile Strength, ksi | 0.2% Yield Strength, ksi | Conductivity % IACS |
|---|---|---|---|---|---|---|
| X95 | — | 0.11 | bal. | 65 | 62 | 96.5 |
| 1696 | 0.03 | 0.14 | bal. | 69 | 66 | 94 |
| 1429 | 0.054 | 0.09 | bal. | 75 | 72 | 73 |
| OFHC | — | — | bal. | 66 | 63 | 99 |
| DHP* | 0.02 | — | bal. | 64 | — | 85** |

*Data for DHP copper is from A.S.M. Metals Handbook Vol. 1, pages 1010-1011, Table 2.

**Annealed conductivity

From the above table, it can be seen that the alloys of the present invention achieve comparable levels of strength and conductivity with a savings in cost of materials and processing.

The alloys of this invention have particular application for structural electrical components such as electrical contacts, electrical receptacles, electrical connectors and the like All of the compositions specified in this application are given in percentage by weight.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A heat treated copper base alloy possessing high conductivity which consists, in weight percent, essentially of: from about 0.03 to about 0.5% of an element, selected from the group consisting of the lanthanide series and mixtures thereof, and from about 0.01 to about 0.1% of phosphorus, balance copper, the lanthanide and phosphorus being added in substantially stoichiometric ratio or proportions and further characterized by being substantially free of low melting point eutectics.

2. The alloy of claim 1 wherein said element consists essentially of mischmetal.

3. The alloy of claim 1 wherein said element comprises cerium.

4. The alloy of claim 1 wherein said element consists essentially of from about 0.05 to about 0.4% and said phosphorus is present in an amount ranging from about 0.02 to about 0.1%.

5. The alloy of claim 1 wherein said alloy contains precipitate particles of the compound CeP.

6. The alloy of claim 1 wherein the amount of said element present does not exceed the amount determined by said ratio by more than 0.05%.

7. The alloy of claim 6 wherein said stoichiometric ratio is about 4.52:1.

* * * * *

UNITED STATES PATENT AND TRADEMARK OFFICE

CERTIFICATE OF CORRECTION

PATENT NO. : 3,976,477

DATED : August 24, 1976

INVENTOR(S) : Jacob Crane and Eugene Shapiro

It is certified that error appears in the above-identified patent and that said Letters Patent are hereby corrected as shown below:

Column 4, line 40, after "foil" delete "be" and insert --by--.

Column 6, line 47, after "like" insert --.--.

Column 7, lines 3 and 4, after "element" delete "comprises" and insert --consists essentially of--

Signed and Sealed this

Ninth Day of November 1976

[SEAL]

*Attest:*

RUTH C. MASON
*Attesting Officer*

C. MARSHALL DANN
*Commissioner of Patents and Trademarks*